US005245394A

United States Patent [19]

Ikeda et al.

[11] Patent Number: 5,245,394

[45] Date of Patent: Sep. 14, 1993

[54] IMAGE FORMING APPARATUS HAVING AN OPENABLE CONVEYANCE PATH

[75] Inventors: Tadayoshi Ikeda; Satoshi Haneda; Hisao Satoh; Shizuo Morita; Masakazu Fukuchi, all of Hachioji, Japan

[73] Assignee: Konica Corporation, Tokyo, Japan

[21] Appl. No.: 837,370

[22] Filed: Feb. 14, 1992

[30] Foreign Application Priority Data

Mar. 20, 1991 [JP] Japan ..... 3-057011
Mar. 20, 1991 [JP] Japan ..... 3-057012

[51] Int. Cl.[5] ..... G03G 21/00
[52] U.S. Cl. ..... 355/309; 355/210
[58] Field of Search ..... 355/200, 210, 211, 308, 355/309

[56] References Cited

U.S. PATENT DOCUMENTS 4,531,823 7/1985 Deguchi et al. .
4,791,454 12/1988 Takahashi .
4,939,541 7/1990 Sugiura ..... 355/210 X
4,972,227 11/1990 Onoda et al. ..... 355/210
5,049,945 9/1991 Fukano et al. ..... 355/290
5,065,195 11/1991 Haneda et al. ..... 355/210 X

*Primary Examiner*—R. L. Moses
*Attorney, Agent, or Firm*—Frishauf, Holtz, Goodman & Woodward

[57] ABSTRACT

An image forming apparatus, which transfers a toner image from an image carrying member to a recording sheet at a transfer location, comprises a process cartridge and a path forming member. The process cartridge is detachably provided to the main frame of the image forming apparatus, and carries therein at least an image forming member. The path forming member assumes a closed position to form a conveying path for the recording sheet to a transfer location in response to the attachment of the process cartridge, and assumes an open position to provide direct access by an operator to the transfer location in response to detachment of the process cartridge.

13 Claims, 9 Drawing Sheets

IMAGE FORMING APPARATUS HAVING AN OPENABLE CONVEYANCE PATH

BACKGROUND OF THE INVENTION

The present invention relates to an image forming apparatus detachably provided with a cartridge in which process materials such as an image carrier are integrally assembled.

In order to obtain color images by means of an electrophotographic method, an apparatus is provided in which a color image is formed in such a manner that: a latent image is formed based on the number of separated colors of a document image. Development by color toner is repeatedly conducted so that color toner images can be superimposed on a photoreceptor drum or a photoreceptor belt; and the formed color toner images are transferred onto a transfer sheet so as to obtain a color toner image. The basic process of the aforementioned multicolor color image formation is disclosed in the Japanese Patent Publication Open to Public Inspection Nos. 75850/1985, 76766/1985, 95456/1985, 95458/1985, and 158475/1985, which are applied by the inventors.

In the multi-color image forming apparatus by which a color image can be obtained by the aforementioned superimposing process, a plurality of developing units, in which different color toners are contained, are provided around a photoreceptor, and generally the photoreceptor is rotated a plurality of times so that latent images can be developed into a color image.

In the aforementioned image forming apparatus, the following structure is adopted. That is, some of the image forming means are provided in a cartridge. For example, replace the photoreceptor and the cleaning member, the lives of which are limited, can be replaced, by use of a cartridge. The cartridge can also supply developer carrier and developer toner when they are consumed. In the case of an image forming apparatus of a digital system, a laser writing system is utilized for the latent image forming means to form an image on the surface of a photoreceptor. In the case of the aforementioned laser writing system, some units are integrally formed into a cartridge so as to be detachably provided to the apparatus body.

In the aforementioned image forming apparatus, the process cartridge can be easily maintained, and further, when the process cartridge is removed from the apparatus body, the image transfer region can be widely opened, so that jam clearance of a transfer sheet, inspection of the conveyance surface and cleaning can be conducted with ease. Various, proposals have been made in which a conveyance passage for a transfer sheet, onto which an image is formed by an image forming means, is opened in order to take out a jammed transfer sheet easily.

However, it is troublesome to open the passage of a transfer paper by hand after the cartridge has been removed from the apparatus. Further, if the cartridge is inserted into the apparatus by mistake when the conveyance passage is opened, there is a possibility of the units becoming damaged.

Further, a transfer electrode charged with high voltage, a fixing roller heated at high temperature and members to convey transfer papers are disposed in the transfer region. When they are exposed upon removal of the process cartridge, it is dangerous to touch them carelessly, so that it is necessary to provide a safeguard.

SUMMARY OF THE INVENTION

The aforementioned problems are solved by the present invention, and it is the first object of the present invention to provide an image forming apparatus in which the transfer paper passage can be automatically opened and closed and its paper feeding direction can be always accurately set with regard to the image transfer surface.

The second object of the present invention is to provide an image forming apparatus in which electric power supply or control action with regard to each member is automatically cut off in accordance with the movement of the process cartridge so as to perform jam clearance and maintenance safely.

The aforementioned object can be accomplished by an image forming apparatus in which a process cartridge, including at least a photoreceptor can be detachably provided to the integrally formed main frame of the apparatus, comprising: forming the transfer paper passage on the upstream side of the image transfer region when the aforementioned process cartridge is attached to the main frame of the apparatus.

The aforementioned object can be accomplished by an image forming apparatus in which a process cartridge, at least including a photoreceptor, can be detachably provided to the integrally formed main frame of the apparatus, comprising: opening and closing of the transfer paper passage provided on the upstream side of the image transfer region can be performed when the aforementioned process cartridge is attached to the main frame of the apparatus.

The aforementioned object can be accomplished by an image forming apparatus in which a process cartridge at least having an image carrier, is movably provided to the image forming apparatus and the transfer region is opened when the aforementioned cartridge is moved, comprising: stopping motion in the apparatus simultaneously with the movement of the cartridge.

DETAILED DESCRIPTION OF THE PREFERRED EMBODIMENTS

Figure 1:
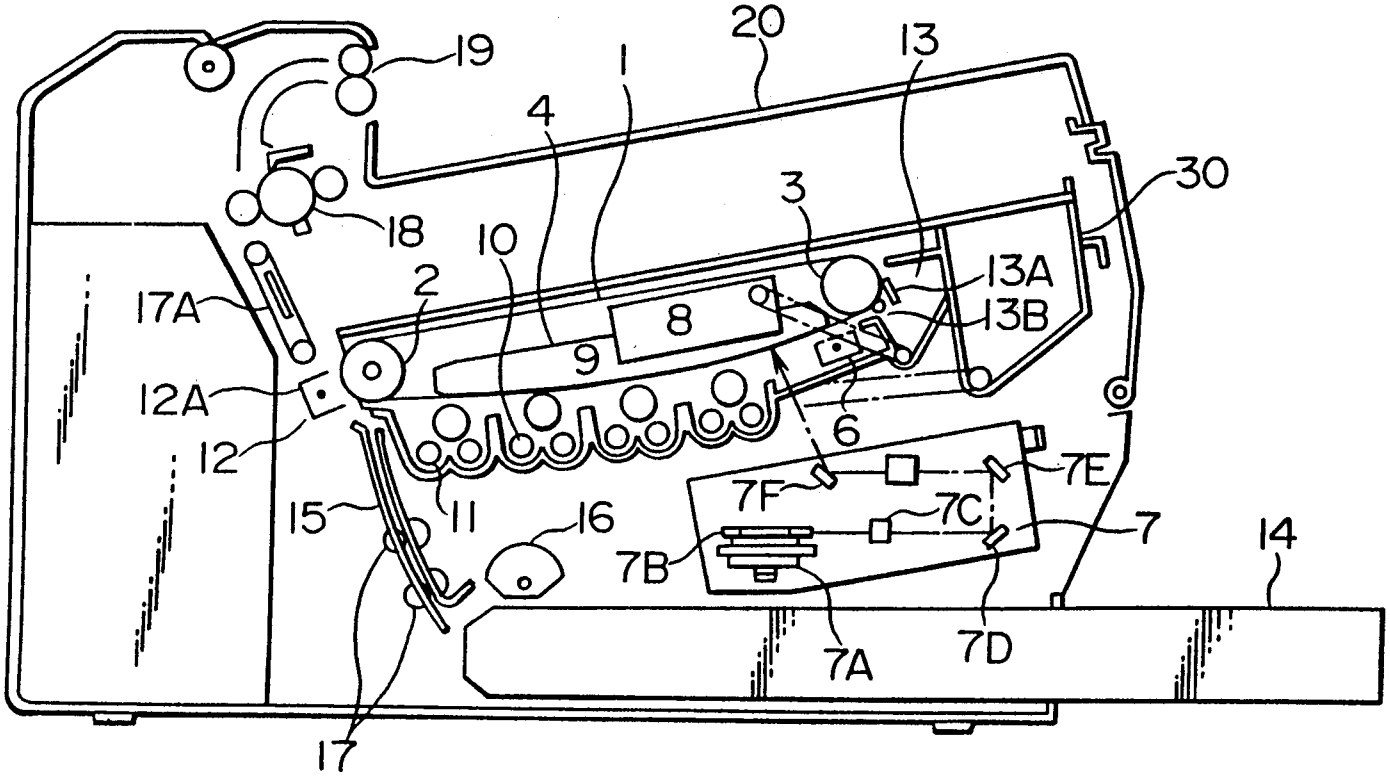
FIG. 1 is a sectional view showing the structure of an image forming apparatus of the present invention.
Figure 2:
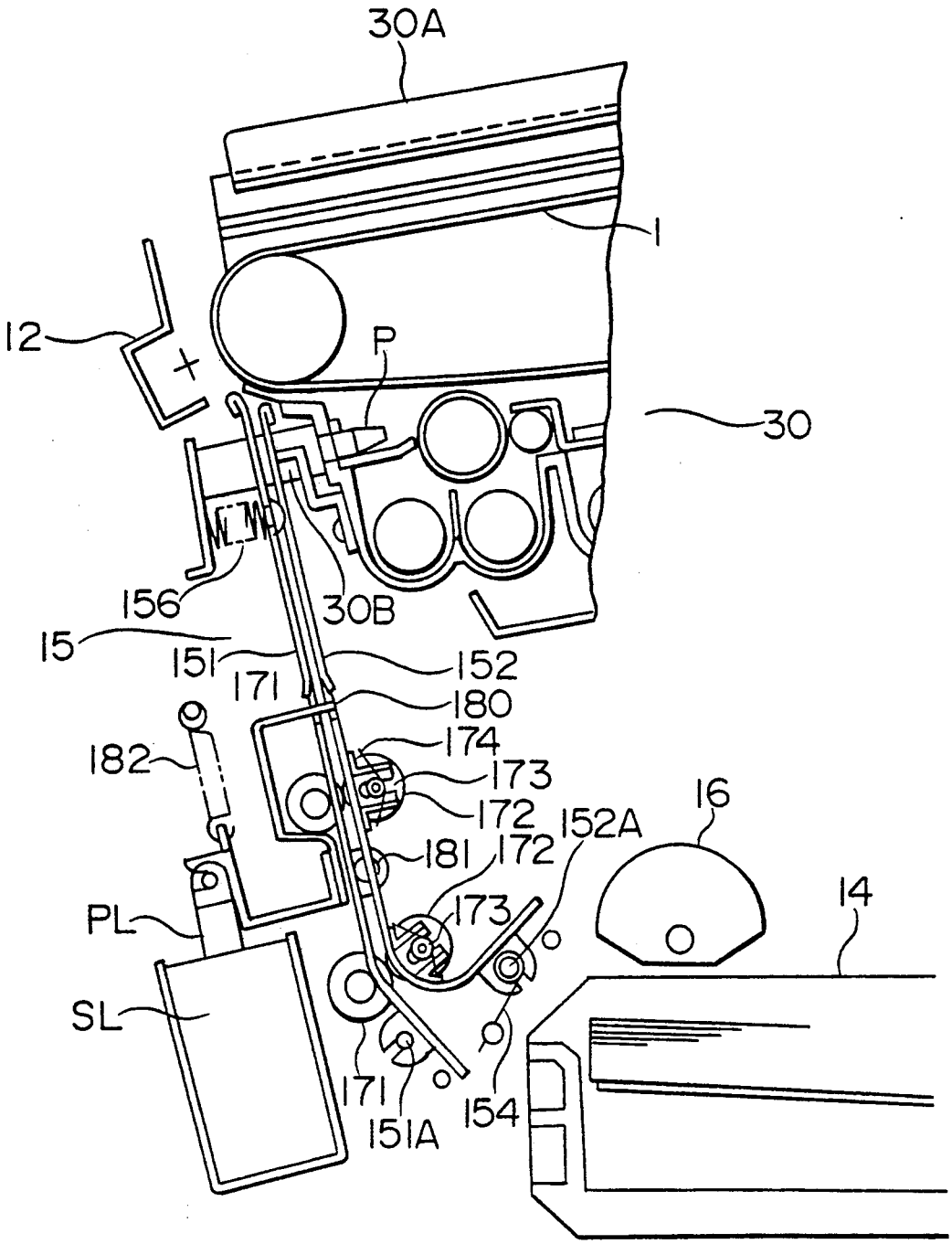
FIG. 2 is a detailed view showing a paper feed conveyance passage when a process cartridge is attached.
Figure 3:
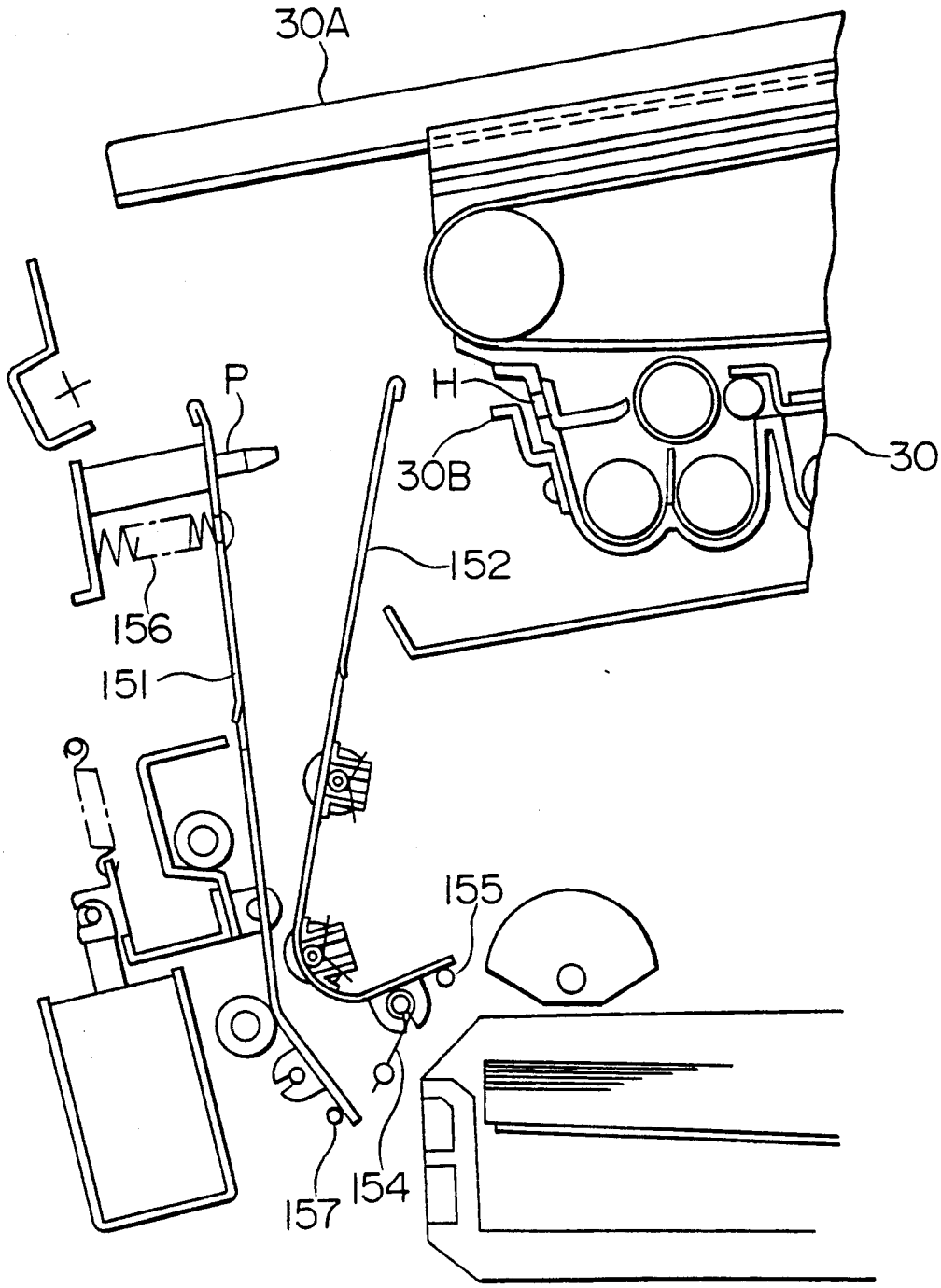
FIG. 3 is a detailed view showing a paper feed conveyance passage when a process cartridge is attached.

An embodiment of the image forming apparatus of the present invention is shown in FIG. 1 to FIG. 3.

In FIG. 1, numeral 1 is a flexible photoreceptor belt which is a belt-like photoreceptor. The photoreceptor belt is stretched around a drive roller 2 and a driven roller 3, and conveyed clockwise by the drive roller 2.

Numeral 4 is a support member, that is, a guide member which is fixed to the apparatus main body so that it can guide the photoreceptor belt 1. A tension can be given to the photoreceptor belt 1 when the driven roller 3 is pushed outward so that the aforementioned guide member 4 can slidably contact an inner peripheral surface of the photoreceptor belt 1.

Accordingly, a photoreceptor on an outer peripheral surface of the aforementioned photoreceptor belt 1 is always held at a constant distance from the surface of the aforementioned guide member 4 in a conveyance operation, and thereby a stable image forming surface can be structured.

Numeral 6 is a scorotron charger, which is a charging means, numeral 7 is a laser writing system unit, which is an image exposure means, and numerals 8 to 11 are developing means, that is, a plurality of developing units which contain a specific colored developer respectively. Each image forming means is provided to face the outer peripheral surface of the photoreceptor belt 1, on the back side of which the guide member 4 is provided.

Apart from the optical system shown in the drawings, an optical system in which a light emitting section is integrally provided with a convergent light transmitter, can be used for the aforementioned laser writing unit 7.

The aforementioned developing units 8, 9, 10, and 11 contain, for example, yellow, magenta, cyan, and black developers respectively, have developing sleeves which keep a predetermined gap from the photoreceptor belt 1, and a latent image can be formed on the photoreceptor belt 1 by the method of non-contact development. The method of non-contact development has an advantage in that a movement of the photoreceptor belt is not obstructed.

Numeral 12 is a transfer unit, numeral 12A is a discharge bar, and numeral 13 is a cleaning unit. A blade 13A of the cleaning unit 13 and a toner conveyance roller 13B are held in a position apart from the surface of the photoreceptor belt 1 while an image is being formed, and contact the surface of the photoreceptor belt 1, as shown in the drawings, only when cleaning is conducted after image transfer.

Color image formation by the aforementioned image forming apparatus is conducted as follows.

Multi-color image formation in this embodiment is conducted according to the following image forming system. Data obtained in a color image data input section in which an original image is scanned by an image pick-up element, is arithmetically processed in an image data processing section so that image data can be made, and the image data is stored temporarily in an image memory. Next, the image data in the image memory is read out when recording is conducted, and inputted into a color image forming apparatus which is a recording section, for example, shown in FIG. 1.

When a color signal outputted from an image reading device which is separately provided from the aforementioned printer, is inputted into the laser writing system unit 7, rotational scanning is performed by a laser beam generated by a semiconductor laser (not shown) with a polygonal mirror 7B which is rotated by a drive motor 7A, and the optical path of the laser beam is curved by mirrors 7D, 7E, and 7F through an $f\theta$ lens 7C, and then projected on the peripheral surface of the photoreceptor belt 1 upon which an electric charge has been previously given by the charger 6 which is a charging means, so that a bright line can be formed on the peripheral surface of the photoreceptor belt 1.

When scanning is started, the beam is detected by an index sensor, beam modulation by the first color signal is started, and the modulated beam scans the aforementioned surface of the photoreceptor belt 1. Accordingly, a latent image of the first color is formed on the surface of the photoreceptor belt 1 by the primary scanning performed by a laser beam and the subsidiary scanning is performed by conveyance of the photoreceptor belt 1. The latent image is developed by the developing unit 8 loaded with yellow (Y) toner (visual image media) in the developing means, and a toner image is formed on the surface of the belt. The obtained toner image passes under the cleaning unit 13 which is a cleaning means separated from the peripheral surface of the photoreceptor belt 1, while the toner image is held on the surface of the belt, and the operation advances to the next copy cycle.

The aforementioned photoreceptor belt 1 is charged again by the charger 6. Next, the second color signal outputted from the signal processing section is inputted into the aforementioned writing system unit 7, and writing on the surface of the photoreceptor belt is conducted in the same way as the case of the aforementioned first color signal so that the latent image can be formed. The latent image is developed by the developing unit 9 loaded with magenta (M) toner as the second color.

The magenta toner image is formed on the aforementioned yellow (Y) toner image which has been formed before.

Numeral 10 is a developing unit loaded with cyan (C) toner, and forms a cyan (C) toner image on the surface of the photoreceptor drum according to the control signal generated in the signal processing section.

Numeral 11 a developing unit loaded with black toner, and forms a black toner image by superimposing the black toner image on the surface of the photoreceptor belt in the same manner as described above. A DC or an A.C. bias voltage is impressed upon each sleeve of developing units 8, 9, 10 and 11, and jumping development, in other words, non-contact development, by a two-component developer, which is an image visualizing means, is conducted on the photoreceptor, the frame of which is grounded. In this case, a non-contact development method in which one-component developer is used, can be adopted for the developing method.

Thus, the color toner image formed on the peripheral surface of the photoreceptor belt 1 is transferred onto a transfer paper which is fed from a paper feeding cassette 14 through a paper feeding passage 15, in the transfer section.

That is, the uppermost sheet of the transfer materials loaded in the paper feeding cassette 14 is conveyed by rotation of a paper feeding roller 16 and supplied to the transfer unit 12 through a timing roller 17 synchronously with an image formation on the photoreceptor belt 1.

The transfer material onto which the image is transferred, and from which the electric charge is discharged, is positively separated from the photoreceptor belt 1, the moving direction of which is sharply changed around the aforementioned driven roller 2, and moved upward through an attraction type conveyance belt 17A, and the image is fixed by a fixing roller 18, and after that, the transfer material is discharged through a discharging roller 19 onto a tray formed on an upper cover 20.

The photoreceptor belt 1 from which the image has been transferred onto the transfer material, is further conveyed on. Residual toner on the photoreceptor belt 1 is removed by the aforementioned cleaning unit 13, the blade 13A and conveyance roller 13B of which come into contact with the photoreceptor belt 1, and after that, the aforementioned blade 13A is separated again from the photoreceptor belt 1. A little after that, the toner conveyance roller 13B levels toner deposited on the tip of the blade 13A, and then the toner conveyance roller 13B is separated from the photoreceptor belt 1 so that the operation advances to a new image forming process.

The aforementioned photoreceptor drum 1, charger 6, each developing unit, and cleaning unit 13 are integrally incorporated into an independent process cartridge 30 as process materials for the image formation, and detachably provided to the apparatus main body.

As shown in FIGS. 2 and 3, the paper conveyance passage 15 is composed of a rotatable guide plate 151 which can be rotated around a shaft 151A, and a rotatable guide plate 152 which can be rotated around a shaft 152A.

A pair of drive rollers 171 composing the paper feed rollers 17, are provided on the rotatable guide plate 151 side, and a pair of idle rollers 172 coming into contact with the drive rollers 171 with pressure, are provided on the rotatable guide plate 152 side.

The support shafts of the aforementioned idle rollers 172 are guided by guide slits 173 so that the idle rollers 172 can be moved in the direction perpendicular to the paper conveyance surface. Also, the idle rollers 172 are strongly pushed by twist springs 174, both ends of which are fixed, so that the idle rollers 172 come into contact with the drive rollers 171 with pressure.

While the idle rollers 172 are contacted with the drive rollers 171 with pressure, the rotatable guide plate 152 is pushed clockwise by a twist spring 154, and the upper edge of the rotatable guide plate 152 comes into contact with a restricting member 30B disposed on the front of the process cartridge 30.

On the other hand, the rotatable guide plate 151 comes into contact with the rotatable guide plate 152 by the action of a compression spring 156 provided on the apparatus body side. A transfer paper is guided and conveyed by the paper conveyance passage 15 and the paper feed rollers 17, the structure of which is described above.

A transfer paper which has been conveyed out from the paper feed cassette 14, is conveyed to the paper feed passage 15 by the paper feed rollers 17, and stops, coming into contact with a stopping member 180, so that slippage occurs between the transfer paper and the paper feed rollers 17.

When solenoid SL is changed over by a signal in synchronization with image formation performed on the photoreceptor belt 1, plunger PL is moved and the aforementioned stopping member 180 is rotated counterclockwise around the shaft 181, so that the stopping member 180 is withdrawn from the paper conveyance surface. Accordingly, the transfer paper is conveyed to the image transfer region by the paper feed roller 17, and then an image is transferred onto a predetermined portion of the transfer paper.

On the other hand, the process cartridge 30 is inserted into the apparatus, being supported by a pair of guide rails 30A provided to the apparatus body. A pair of holes H formed on the front of the process cartridge 30 are engaged with a pair of reference pins P so that the process cartridge 30 can be placed in a predetermined position by the action of its own weight and fixed by a click device.

As shown in FIG. 3, the process cartridge 30 can be pulled out upward to the right along the guide rail 30A. As a result, the restricting member 30B is withdrawn, so that the rotatable guide plate 152 is rotated clockwise since it is pushed by the twist spring 154. When the guide plate 152 comes into contact with a stopper 155, the rotation of the guide plate is stopped.

While the movable guide plate 152 is rotated clockwise, the movable guide plate 151 is also rotated clockwise by the action of the compression spring 156, and the rotation of the guide plate 151 is stopped when it comes into contact with a stopper 157.

The conveyance surface for the transfer sheet can be opened widely when the rotation angle of the movable guide plate 151 is maintained at the minimum and that of the movable guide plate 152 is made as large as possible.

When the transfer paper conveyance surface is opened widely as mentioned above, jam clearance and maintenance such as cleaning and inspection can be easily carried out, and further when the process cartridge 30 is provided to the apparatus, the transfer sheet can be correctly fed to the image transfer region.

The second example of the present invention will be explained as follows.

Except for the paper conveyance section, the second example is essentially the same as the aforementioned first example. Therefore, the explanation of the portions common between the first and the second example will be omitted here. Only the conveyance passage portion will be explained, referring to FIGS. 4 and 5.

A paper conveyance passage 15 is composed of a fixed guide plate 151 and a movable guide plate 152 which can be rotated around a shaft 153.

A pair of drive rollers 171 composing paper feed rollers 17, are provided on a fixed guide plate 151 side, and a pair of idle rollers 172 coming into contact with the drive rollers 171 with pressure, are provided on a rotatable guide plate 152 side.

The support shafts of the aforementioned idle rollers 172 are guided by guide slits 173 so that the idle rollers 172 can be moved in the direction perpendicular to the paper conveyance surface. Also, the idle rollers 172 are strongly pushed by twist springs 174, both ends of which are fixed, so that the idle rollers 172 come into contact with the drive rollers 171 with pressure.

Figure 4:
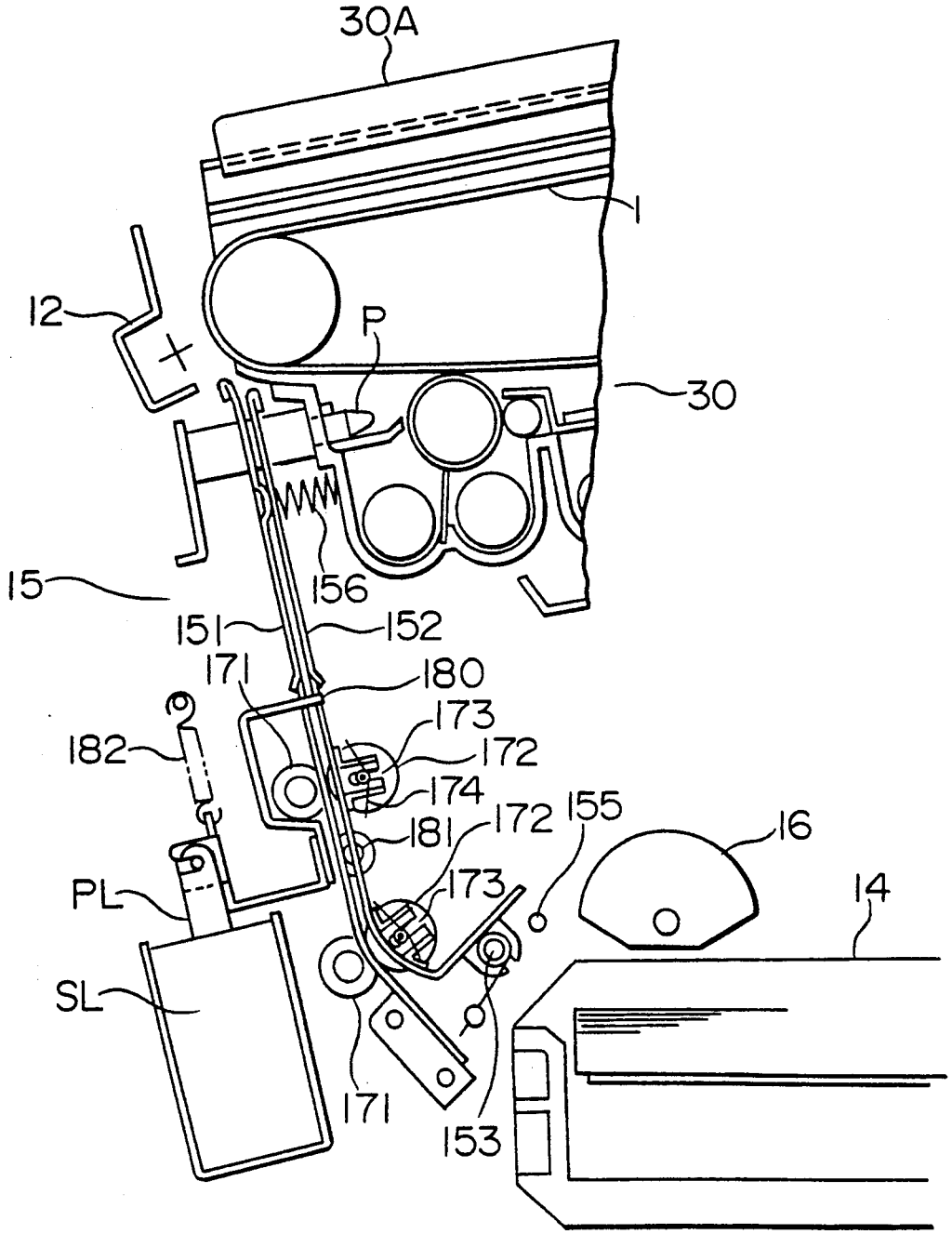
FIG. 4 is a detailed view showing a paper feed conveyance passage when a process cartridge is attached.

A compression spring 156 is provided to the upper end of the rotatable guide plate 152. When the the process cartridge 30 is provided, the compression spring 156 is compressed by the process cartridge 30 as shown in FIG. 4, so that the rotatable guide plate 152 comes into contact with the fixed guide plate 151. Due to the foregoing, paper conveyance by the paper conveyance passage 15 and the paper feed rollers 17 can be effected.

A transfer paper which has been conveyed out from the paper feed cassette 14, is conveyed to the paper feed passage 15 by the paper feed rollers 17, and stops, coming into contact with a stopping member 180, so that slippage occurs between the transfer paper and the paper feed rollers 17.

When solenoid SL is changed over by a signal in synchronization with image formation performed on the photoreceptor belt 1, plunger PL is moved and the aforementioned stopping member 180 is rotated counterclockwise around the shaft 181, so that the stopping member 180 is withdrawn from the paper conveyance surface. Accordingly, the transfer paper is conveyed to the image transfer region by the paper feed roller 17, and then an image is transferred onto a predetermined portion of the transfer paper.

The process cartridge 30 is inserted into the apparatus, being supported by a pair of guide rails 30A provided to the apparatus body. A pair of holes H formed on the front of the process cartridge 30 are engaged with a pair of reference pins P so that the process cartridge 30 can be placed in a predetermined position by the action of its own weight and fixed by a click device.

Figure 5:
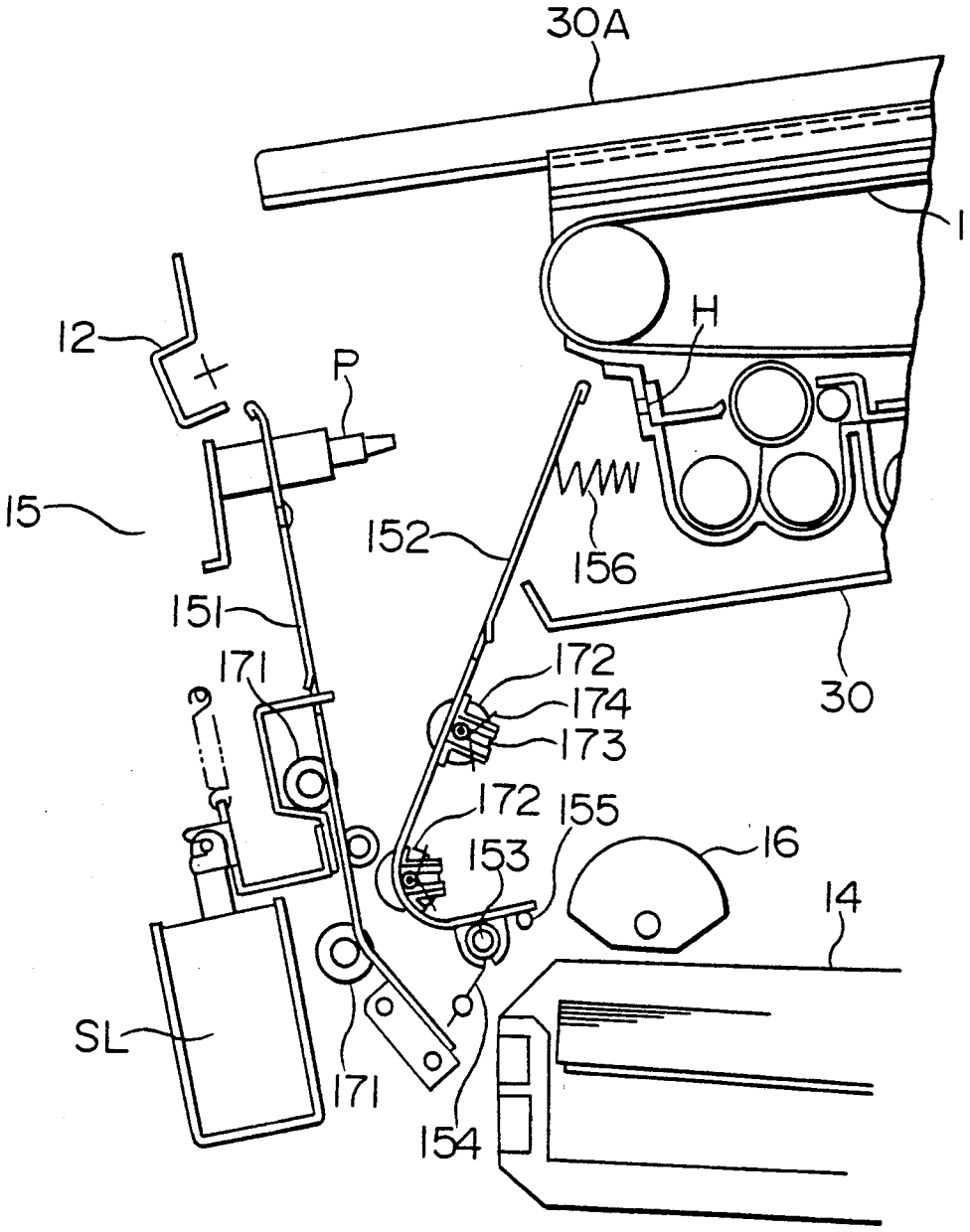
FIG. 5 is a detailed view showing a paper feed conveyance passage when a process cartridge is detached.

As shown in FIG. 5, the process cartridge 30 can be pulled out upward to the right along the guide rail 30A. As a result, the pushing force given to the compression spring 156 is released, so that the rotatable guide plate 152 is rotated clockwise since it is pushed by the twist spring 154. When the guide plate 152 comes into contact with a stopper 155, the rotation of the guide plate is stopped.

As a result, the paper conveyance passage 15 is widely opened, and at the same time, each idle roller 172 is withdrawn from the position where the idle roller 172 comes into contact with the drive roller 171. Consequently, a jammed transfer paper can be easily and quickly removed.

Referring to FIG. 6 to FIG. 9, the third example of the present invention will be explained as follows.

Figure 6:
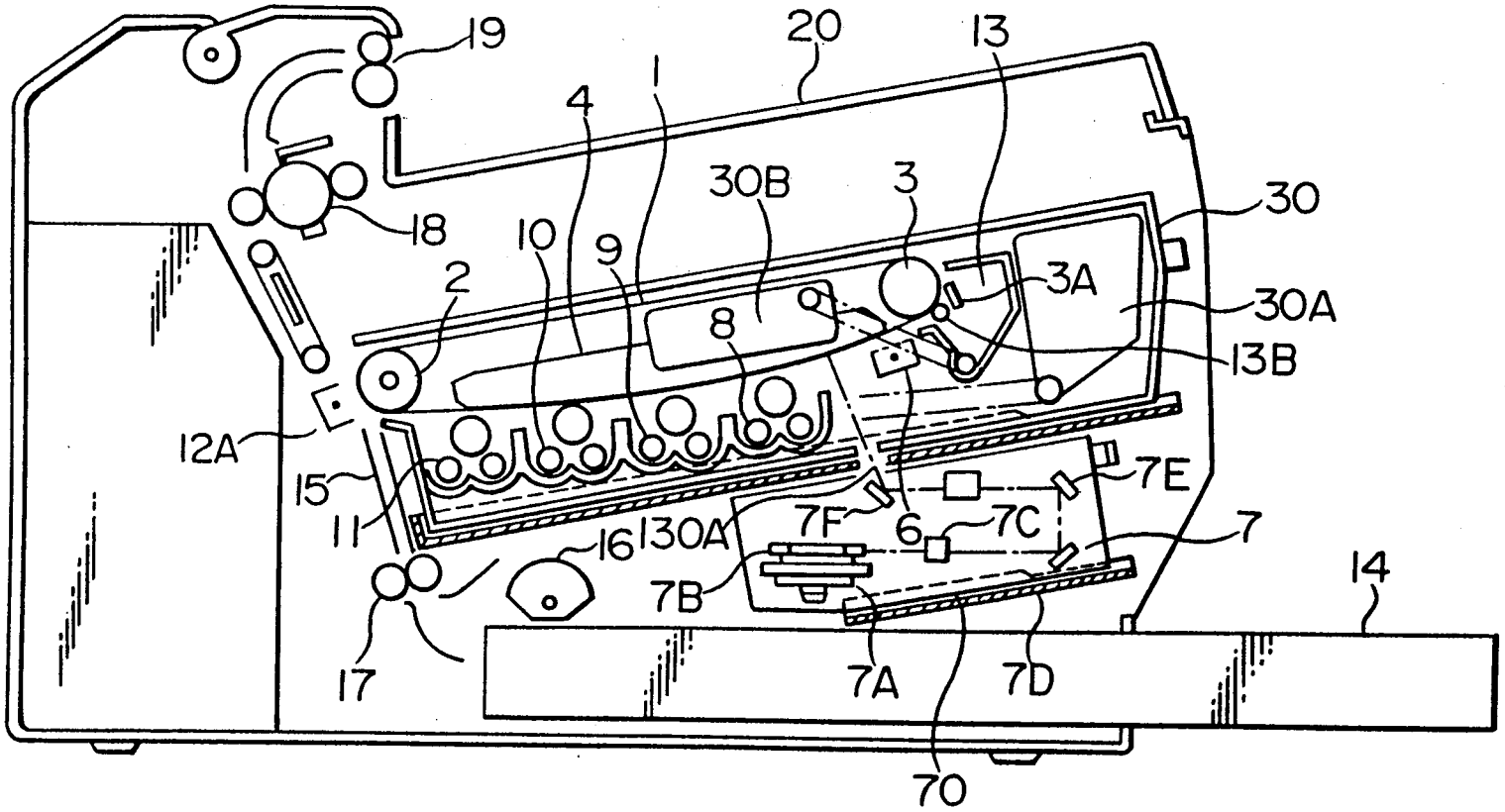
FIG. 6 is is a sectional view showing the structure of an image forming apparatus of the present invention.

FIG. 6 shows an image forming apparatus of this example. The mechanical structure of this example is approximately the same as that of the first example. Like parts in each of FIG. 1 and FIG. 6 are identified by the same reference characters.

Figure 7:
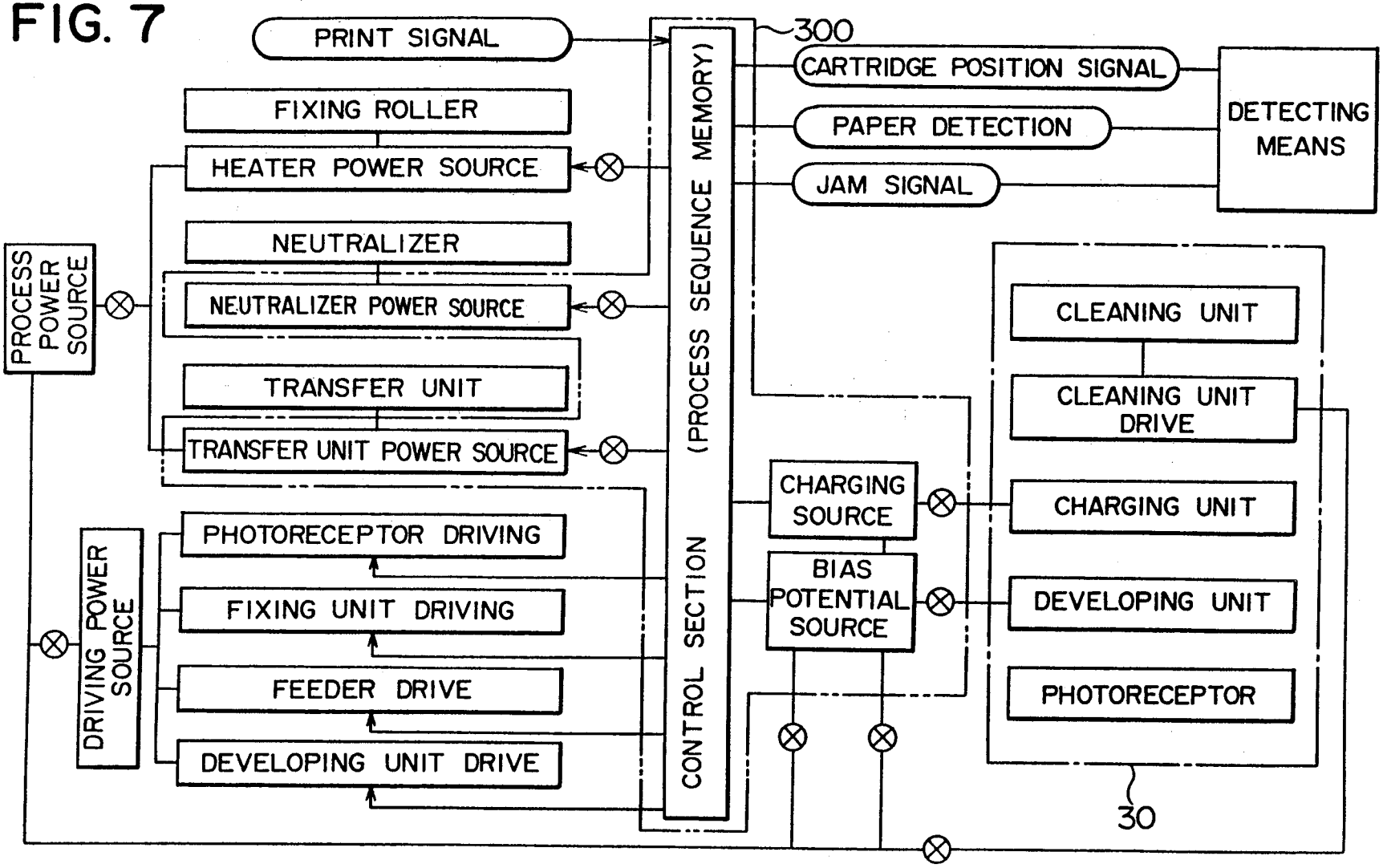
FIG. 7 is a block diagram showing the electric power source and control circuit of the aforementioned apparatus.

Explanations of units common between the first and the third example will be omitted here. FIG. 7 is a block diagram showing the power supply circuit and control circuit of the image forming apparatus of the third example.

In FIGS. 6 and 7, when the main switch (not shown) of the apparatus is turned on, electric power is supplied to the process cartridge. Then, the heater of a fixing roller 18 is turned on. At the same time, electric power is supplied to a discharging bar 12A, a transfer unit 12, the drive units of photoreceptor belt 1 and developing units, a charger 6, and a bias voltage power unit of each developing unit, so that the aforementioned units are ready to start.

The control section of the aforementioned units is structured in such a manner that: signals sent from each detecting means are inputted into a process sequence memory installed in the control section; and when a print signal is inputted by the operation of a copy button (not shown) under the condition that a positional signal of the process cartridge is detected and that neither a paper signal nor a jam signal are detected, the control section outputs signals to the aforementioned image forming means, the power source, and the drive force transmission system, so that the image forming process can be carried out.

A photoreceptor drum 1, the charger 6, developing units and a cleaning unit 13 are integrally assembled in a process cartridge 30, which acts as an independent member for providing process materials for image formation, which is detachably provided to the apparatus body.

On the other hand, a laser writing system unit 7 is incorporated to a frame 70, and attached to and detached from the apparatus in the same way as the process cartridge 30.

Figure 8:
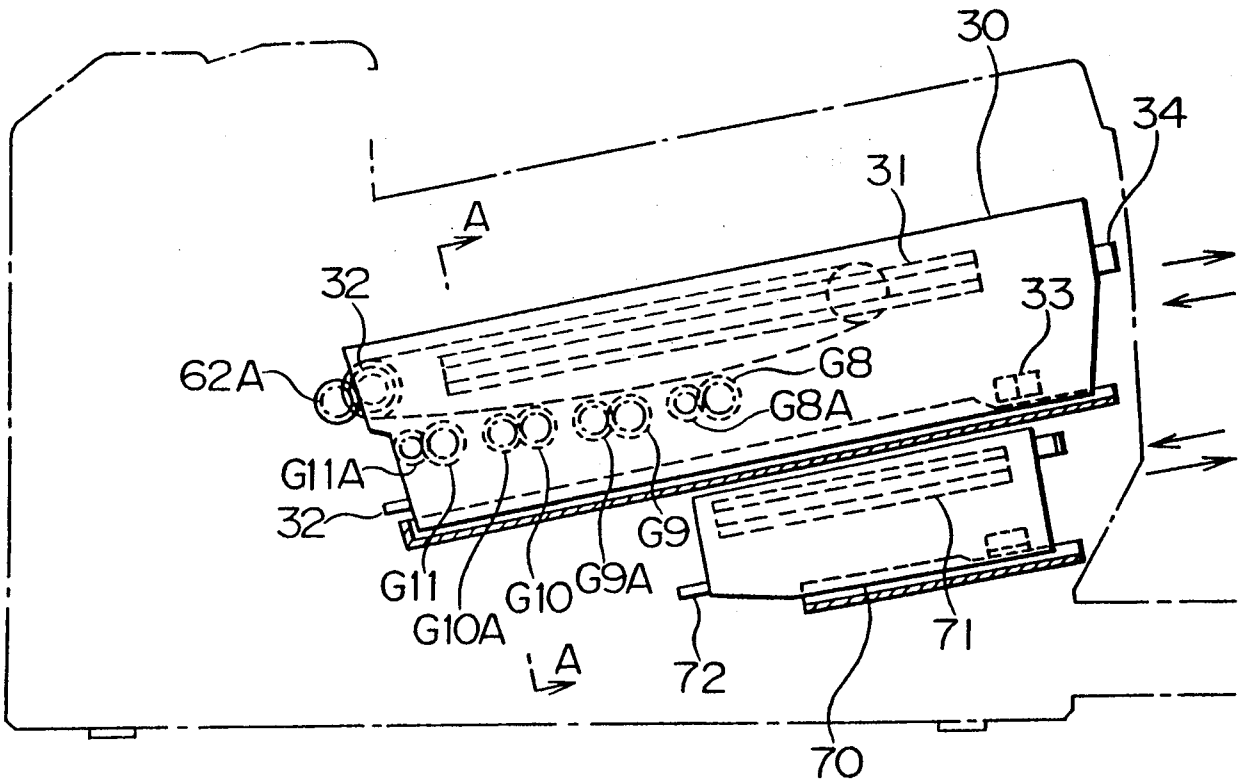
FIG. 8 is a schematic illustration explaining the essential portion of the aforementioned apparatus.

As shown in FIG. 8, the process cartridge 30 and the frame 70 in which the laser writing system unit 7 is installed , are inserted into the apparatus from the right through a guide member 31 or a guide member 71. Then, the process cartridge 30 and the frame 70 respectively come into contact with a stopper 32 or a stopper 72 so that they are set in a predetermined position.

Gears G2, G8, G9, G10 and G11 are provided on the extended shafts of a rotating roller 2 and developing sleeves of the developing units in such a manner that the gears are protruded from the back portion of the process cartridge 30. Consequently, when the process cartridge 30 is set to a predetermined position, the aforementioned gears are respectively engaged with gears G2A, G8A, G9A, G10A and G11A simultaneously.

Figure 9:
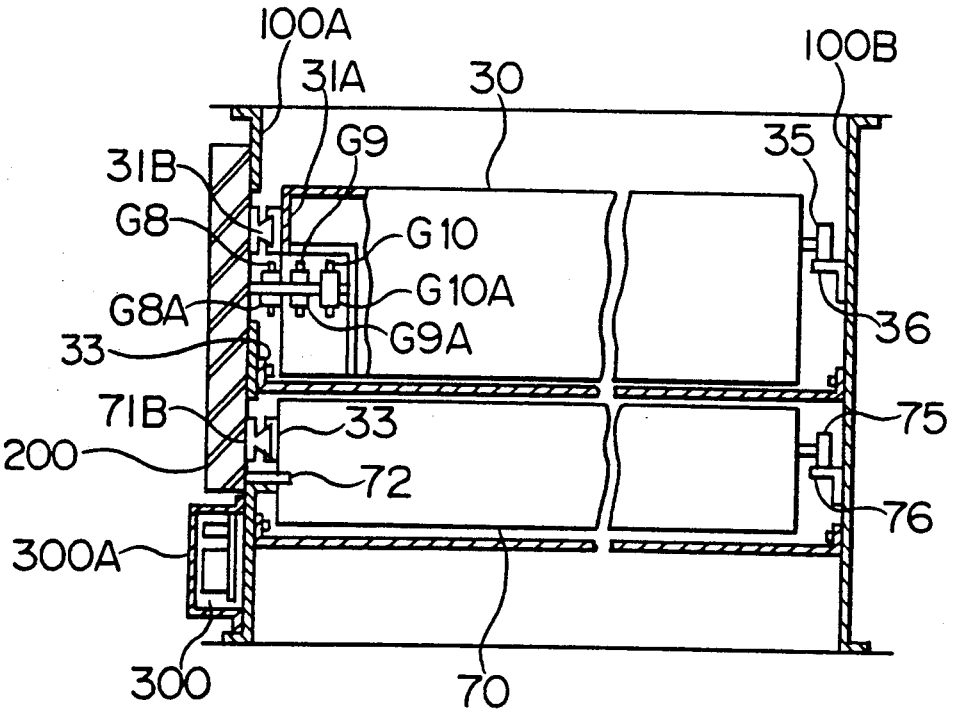
FIG. 9 is a sectional view showing the essential portion of the aforementioned apparatus.

FIG. 9 is a sectional view taken on line A—A in FIG. 8.

The aforementioned guides 31 and 71 are respectively composed of guide members 31A and 71A, the sectional shape of which is a U-shaped wedge, and guide members 31B and 71B, the sectional shape of which is a dovetail. The guide members 31A and 71A are respectively fixed to the back of the process cartridge 30 and that of the frame 70. Both the guide members 31B and 71B are penetrated through a panel 100A on the back side, and directly fixed to a drive unit 200 installed outside the panel.

Rotatable rollers 35 and 75 are respectively provided in the front portion of the process cartridge 30 and the frame 70. The rotatable rollers 35 and 75 are supported by mounts 36 and 76 which are provided on a panel 100B in parallel with the guides 31 and 71. Accordingly, the process cartridges 30 and the frame 70 can be provided in the apparatus under a well-balanced condition.

In the image forming apparatus of the present invention, the power supply circuit and the control circuit encircled by a two-dotted chain line in the block diagram of FIG. 7 are integrated into a unit which is defined as an electric section 300. The electric section 300 is assembled on the outer side surface of the panel 100A to which a drive unit 200 is provided.

When the wiring of the electric section 300 is simplified, it is easy to assemble the electric section 300 to the apparatus, and further when the electric section 300 is covered with a simple metallic cover 300A, it can be electrically shielded, so that the occurrence of harmful high frequency can be prevented.

When the process cartridge of the image forming apparatus of this example is set to a predetermined position in the apparatus, a magnetic type of connector 33 provided on the back of the process cartridge is connected with a connector of the electric section 300 installed on the apparatus side so that the image forming means (which is shown in the block diagram of FIG. 7 encircled by a one-dotted chain line) provided in the process cartridge 30 can be activated and controlled.

In order to open the image transfer region of the aforementioned apparatus, a handle 34 is pushed so that the process cartridge 30 is moved from the position shown in FIG. 6 in the direction indicated by an arrow mark. Then, the connector 33 is released from the electric section 300, and the power source circuit or the control circuit is automatically cut off at a connector which is expressed by mark (x) in the block diagram of FIG. 7. At the same time, the power source of the process cartridge is turned off by a cartridge position signal which shows the movement of the process cartridge 30.

As described above, when the process cartridge 30 is moved, not only the motion and control of each image forming means but also the connection of the power source of the fixing heater, transfer unit and discharger, and drive force given by the apparatus are automatically cut off to stop the copy operation. Therefore, when an upper cover 20 is opened, jam clearance, inspection and cleaning can be safely performed. The process cartridge which is in the state that the copy operation is stopped, maintains its condition even after it has been taken out from the apparatus. When it is returned to the predetermined position in the apparatus, the aforementioned condition is automatically released, and it returns to the condition in which the copy operation can be conducted.

According to the present invention, the transfer paper conveyance passage is automatically opened and closed when the process cartridge is attached to and detached from the apparatus. As a result, an image forming apparatus can be provided in which misoperation can be prevented, and jam clearance and maintenance can be easily performed, and further a transfer paper can be accurately fed to a predetermined position in the image forming region so that an image of high quality can be obtained.

According to the present invention, the members, power source and drive source disposed closed to the transfer region can be turned off simultaneously when the process cartridge is moved. As a result, an image forming apparatus can be provided in which jam clearance and maintenance can be easily and safely performed, so that the operability is high.

What is claimed is:

1. An image forming apparatus comprising:

a main frame having an insertion path formed therein, said insertion path extending in an insertion direction;

an image carrying member for carrying a toner image on a surface thereof;

a process cartridge including at least said image carrying member, said process cartridge being insertable into and pullable out of said main frame along said insertion path, wherein said process cartridge after insertion into said insertion path of said main frame, is positioned at an operational position where said process cartridge is operationally attached to said main frame;

a transfer device located at a transfer location to face said surface of said image carrying member when said process cartridge is positioned at said operational position thereof;

recording sheet path defining means, formed separately from and excluding said process cartridge, for forming a recording sheet conveyance path to said transfer device; and wherein:

said process cartridge includes means for mechanically contacting and moving said recording sheet path defining means, as said process cartridge is being moved to said operational position, to a position where said recording sheet path defining means is in a closed position to thereby form said recording sheet conveyance path;

said recording sheet path defining means, responsive to a pull out movement of said process cartridge solely within said main frame along said insertion path in a direction away from said operational position, moving from said closed position thereof to open said recording sheet conveyance path to provide direct access by an operator to said opened recording sheet conveyance path for enabling said operator to perform at least one of a recording sheet jam clearing procedure and a maintenance procedure.

2. The image forming apparatus of claim 1, further comprising inhibiting means for inhibiting an operation of said image forming apparatus responsive to a movement of said process cartridge away from said operational position along said insertion path.

3. The image forming apparatus of claim 2, wherein the inhibiting means includes means for inhibiting at least one of operation of a motor driving means and heating of a fixing roller.

4. The image forming apparatus of claim 2, wherein said inhibiting means includes means for inhibiting an operation of said image forming apparatus by disconnecting a plurality of predetermined electric lines at a plurality of predetermined connecting points, responsive to said movement of said process cartridge in a direction away from a operational position along said insertion path.

5. An image forming apparatus comprising:

a main frame having an insertion path formed therein;

an image carrying member for carrying a toner image on a surface thereof;

a transfer device located near said image carrying member;

a process cartridge including at least said image carrying member, said process cartridge being insertable into and pullable out of said main frame along said insertion path, wherein:

said process cartridge includes means for mechanically contacting and moving a recording sheet path defining means, as said process cartridge is being moved to an operational position, to a position where said recording sheet path defining means is in a closed position to form a recording sheet conveyance path; and wherein said process cartridge, upon a pull out movement thereof solely within said main frame along said insertion path in a direction away from said operational position of said process cartridge, permitting said recording sheet path defining means to move from said closed position thereof to thereby form a space to allow an operator direct access to said transfer device and to said recording sheet conveyance path to enable said operator to perform at least one of a recording sheet jam clearing procedure and a maintenance procedure; and disconnecting means, responsive to said pull out movement of said process cartridge, for disconnecting predetermined electrical components of the apparatus from an electrical supply means.

6. The image forming apparatus of claim 5, further comprising inhibiting means for inhibiting an operation of said image forming apparatus responsive to a movement of said process cartridge away from said operational position along said insertion path.

7. The image forming apparatus of claim 6, wherein said inhibiting means includes means for inhibiting at least one of operation of a motor driving means and heating of a fixing roller.

8. The image forming apparatus of claim 6, wherein said inhibiting means includes means for inhibiting an operation of said image forming apparatus by disconnecting a plurality of predetermined electric lines at a plurality of predetermined connecting points, responsive to a movement of said process cartridge in a direction away from said operational position along said insertion path.

9. The apparatus of claim 5, wherein said disconnecting means includes means for inhibiting an image forming operation by disconnecting at least one power supply from said image forming apparatus.

10. An image forming apparatus comprising:

a main body having an insertion path formed therein, said insertion path extending in an insertion direction from an insertion entrance on a surface of said main body to an end position in said main body;

a transfer device located at said end position of said insertion path, said transfer device being positioned to have an orientation such that said transfer device is directed towards said insertion entrance;

an image carrying member for carrying a toner image on a surface thereof;

said image carrying member having a rotation axis that is substantially perpendicular to a direction of movement of a process cartridge along said insertion path;

said process cartridge including at least said image carrying member, said process cartridge being insertable into and pullable out of said main body along said insertion path, wherein said process cartridge, after insertion in said insertion path of said main body, is positioned at an operational position where said process cartridge is operationally attached to said main frame; and recording sheet path defining means, formed separately from and excluding said process cartridge, for forming a recording sheet conveyance path to said transfer device; and wherein:

said process cartridge includes means for mechanically contacting and moving said recording sheet path defining means, as said process cartridge is being moved to said operational position, to a position where said recording sheet path defining means is in a closed position to thereby form said recording sheet conveyance path;

said recording sheet path defining means, responsive to a pull out movement of said process cartridge solely within said main body along said insertion path in a direction away from said operational position, movement from said closed position thereof to open said recording sheet conveyance path to provide direct access by an operator to said opened recording sheet conveyance path to enable said operator to perform at least one of a recording sheet jam clearing procedure and a maintenance procedure.

11. The image forming apparatus of claim 10, further comprising inhibiting means for inhibiting an operation of said image forming apparatus responsive to a movement of said process cartridge away from said operational position along said insertion path.

12. The image forming apparatus of claim 11, wherein said inhibiting means includes means for inhibiting at least one of operation of a motor driving means and heating of a fixing roller.

13. The image forming apparatus of claim 11, wherein said inhibiting means includes means for inhibiting an operation of said image forming apparatus by disconnecting a plurality of predetermined electric lines at a plurality of predetermined connecting points, responsive to said movement of said process cartridge in a direction away from said operational position along said insertion path.

* * * * *